US005979132A

United States Patent [19]

Margarit

[11] Patent Number: 5,979,132

[45] Date of Patent: Nov. 9, 1999

[54] SKIRTING BOARD

[75] Inventor: Juan Lagunas Margarit, Gandia, Spain

[73] Assignee: Novoperfil, S.A., Valencia, Spain

[21] Appl. No.: 09/110,817

[22] Filed: Jul. 7, 1998

[51] Int. Cl.[6] ..... E04F 19/04

[52] U.S. Cl. ..... 52/312; 52/288.1; 52/718.02

[58] Field of Search ..... 52/312, 290, 288.1, 52/718.01, 718.02; 256/1

[56] References Cited

U.S. PATENT DOCUMENTS

| | | | |
|---|---|---|---|
| 1,430,996 | 10/1922 | Horlin | 52/718.01 |
| 2,048,132 | 7/1936 | Madsen | 52/718.02 |
| 2,253,489 | 8/1941 | Smith | 52/288.1 |
| 2,927,339 | 3/1960 | Grunwald | 52/718.02 |
| 3,956,861 | 5/1976 | Rasmussen | 52/288.1 |
| 5,463,835 | 11/1995 | Wood | 52/288.1 |

*Primary Examiner*—Michael Safavi
*Attorney, Agent, or Firm*—Dowell & Dowell, P.C.

[57] ABSTRACT

A skirting board or molding has a longitudinal channel for insertion of a decorative strip of wood. The wood strip being held frictionally within the channel. The board having holes extending therethrough and lying within the channel for receiving screws. The holes possessing counter bores so that the screws will lie flush along the bottom surface of the longitudinal channel. The wood strip may have a thickness less than the depth of the channel so as to create a profiled appearance.

4 Claims, 1 Drawing Sheet

SKIRTING BOARD

CROSS REFERENCES TO RELATED APPLICATIONS

None

BACKGROUND OF THE INVENTION

1. Field of the Invention

The current invention is a specially developed skirting or baseboard intended to cover or hide the existing joint between a floor, for instance a floating floor, and the wall of the room where the floor has been installed.

2. History of the Related Art

When installing floating floors, it is necessary to leave a space between the floor itself and the wall of the room. This space must be large enough to allow any possible expansion of the floor due to climatic fluctuations. The space may vary from 8 to 10 mm.

In order to cover this space, it is common to use a skirting board made of a plain molding. It is placed against the wall and fixed to it with screws set perpendicularly through the molding. This could be done through holes previously made. The bottom of the molding is supported by or close to the floor. These moldings may be made from either HDF or fiberboard and covered by paper, laminates or veneer.

Although such skirting boards hide the existing space between the floor and the wall, the heads of the screws remain uncovered. Being perfectly visible, they spoil the all-over visual effect.

SUMMARY OF THE INVENTION

The current invention has been developed to improve the appearance of skirting boards by allowing the screws to be covered. The skirting board is made in such a way that it has a uniform surface and, consequently, an excellent finish. In addition to this, the heads of the screws are easily accessible whenever it may be necessary, for instance to partially or totally dismantle the skirting board.

According to the current invention, the molding which constitutes the skirting board has in its wider exterior surface a longitudinal channel filled by a strip of wood. The strip of wood fits the channel and will remain in place. The channel is wider than the diameter of the heads of the screws and has, at the bottom, holes through which the screws are introduced and fixed. The heads of the screws are flush with the bottom of the channel, so that there is no difficulty fitting the strip of wood within the channel.

The molding installation process is as follows: 1) after the strip of wood has been removed, the molding must be accurately placed on the wall; 2) once the molding is perfectly placed, it must be screwed in while making sure that the heads of the screws are inset in the holes; and 3) the strip of wood must be placed into the molding channel. The strip will thereafter cover the heads of the screws.

The external surface of the strip of wood may either be flush with the surface of the molding or it may be placed slightly back or recessed from it which offers variations in the final visual effect.

BRIEF DESCRIPTION OF THE DRAWINGS

The advantages and characteristics of the molding will be better understood by looking at the attached drawing figures and the corresponding specification.

DESCRIPTION OF THE PREFERRED EMBODIMENTS

Figure 1:
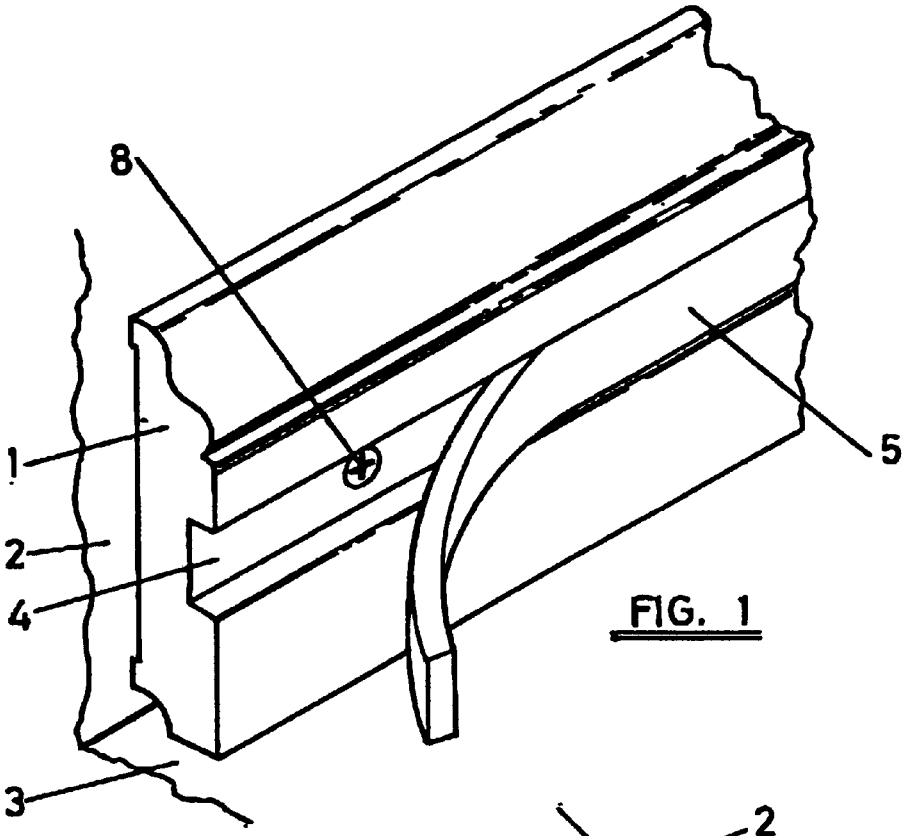
FIG. 1 shows a molding designed according to the invention, fixed to a wall with the strip of wood covering the screws partially removed.
Figure 2:
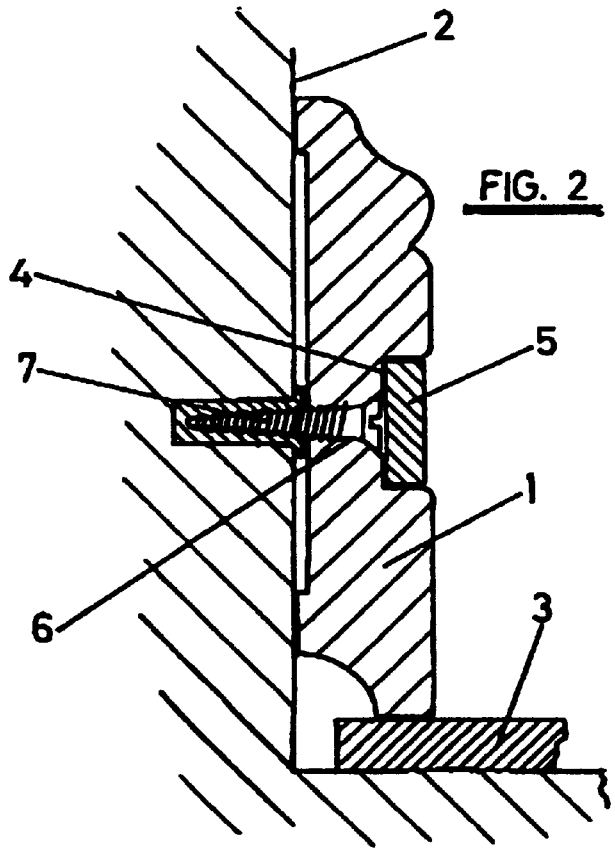
FIG. 2 is a vertical cross-section taken through FIG. 1.

The skirting board shown in the drawing is made of a molding 1 which is obtained, for instance, from HDF or fiberboard and is covered by paper, laminates or veneer. The shape of this kind of molding is plain and its profile can be varied. Its installation consists of placing its back to the wall 2 of the room where the floor 3 has been installed. Thus, the bottom of the molding is supported by or is close to the floor.

Along the exterior wider part of the molding, there is a longitudinal channel 4 in which the strip of wood 5 is fitted. The strip of wood can be removed. The channel 4 has holes 6 at the bottom through which screws 8 are introduced to secure the molding 1 to the wall. The heads of the screws 8 are also introduced or inset in counterbores of the holes 6. Thus, they do not stick out from the bottom surface of the channel.

Once the molding 1 has been fixed to the wall 2 and the screws 8 have been screwed in, it is time to fit the strip of wood 5 in the channel 4. This will cover the heads of the screws 8. The channel 4 will obviously be wider than the diameter of the heads of the screws 8 and the height of the channel is generally equal to the width of the strip. The depth of the channel and the thickness of the strip of wood are equal so that they can be fitted together to present a smooth surface.

Also, the thickness of the strip of wood 5 may be thinner than the depth of the channel 4 so that once the mold strip is fitted, it is slightly indented giving another possible profile.

Whenever desired, the color of the strip of wood 5 may be different from the color of the molding 1 so that the complete molding along with the floor 3 shows a combination of different colors.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A skirting board adapted to be secured to a wall comprising, an elongated body having front and rear surfaces, a longitudinal channel recessed in said front surface of said body, said channel having a width dimension defined perpendicularly to a length of said body and having a depth dimension, a plurality of spaced holes through said body, each of said holes having a countersunk opening communicating with said channel, a plurality of screws extending through said opening such that heads of said screws are seated within said countersunk openings so as to not extend into said channel, said heads of said screws having a diameter which is less than the width of said channel, an elongated wood strip frictionally and removably seated within said channel, said wood strip having a thickness dimension not greater than the depth of said channel and a width dimension substantially equal to the width dimension of said channel.

2. The skirting board of claim 1 wherein said front surface of said body is of a first color, and said wood strip being of a color different than said first color.

3. The skirting board of claim 1 wherein said wood strip has a thickness dimension which is less than the depth of said channel whereby said front surface of said body has a profiled appearance.

4. The skirting board of claim 3 wherein said front surface of said body is of a first color, and said wood strip being of a color different than said first color.

* * * * *